US005309740A

United States Patent [19]

Hansen

[11] Patent Number: 5,309,740

[45] Date of Patent: May 10, 1994

[54] INK TACK

[75] Inventor: Norman B. Hansen, Highland Beach, Fla.

[73] Assignee: Sensormatic Electronics Corporation, Deerfield Beach, Fla.

[21] Appl. No.: 67,163

[22] Filed: May 24, 1993

Related U.S. Application Data

[63] Continuation of Ser. No. 867,812, Apr. 13, 1992, abandoned.

[51] Int. Cl.[5] ..... A44B 9/00

[52] U.S. Cl. ..... 70/57.1; 24/704.1

[58] Field of Search ..... 70/57.1; 24/704.1; 109/34

[56] References Cited

U.S. PATENT DOCUMENTS

| | | | |
|---|---|---|---|
| 2,566,587 | 9/1951 | Srygley | 109/34 |
| 4,299,176 | 11/1981 | Loehle | 109/54 |
| 4,483,049 | 11/1984 | Gustavsson et al. | 70/57.1 |
| 4,670,950 | 6/1987 | Wisecup et al. | 70/57.1 |
| 4,944,075 | 7/1990 | Hogan | 70/57.1 |
| 5,022,244 | 6/1991 | Charlot, Jr. | 70/57.1 |
| 5,031,287 | 7/1991 | Charlot, Jr. et al. | 70/57.1 |
| 5,054,172 | 10/1991 | Hogan et al. | 70/57.1 |
| 5,077,872 | 1/1992 | Guthammer | 70/57.1 |
| 5,088,165 | 2/1992 | Minasy et al. | 70/57.1 |
| 5,205,024 | 4/1993 | Willard | 70/57.1 |

*Primary Examiner*—Peter M. Cuomo
*Assistant Examiner*—Darnell M. Boucher
*Attorney, Agent, or Firm*—Robin, Blecker, Daley & Driscoll

[57] ABSTRACT

A theft-deterrent tack for application to an article to be protected against theft comprises a first component including a first housing having an open end and ceiling and wall structure bounding an interior space extending to the open end, the ceiling and wall structure being continuous, a second housing secured to the first housing and closing the interior space except for at least one opening extending therethrough into the interior space, the second housing having a generally flat surface facing the interior space and vial-confining members extending upwardly thereof into the interior space, at least one frangible vial disposed in the interior space and positioned in preselected position by the vial-confining members, the vial being disposed on the generally flat surface of the second housing, and vial-fracturing means disposed in the interior space and supported for movement therein in interference path with the vial, and a second component including securement means for securing the first component to the article.

10 Claims, 2 Drawing Sheets

INK TACK

This is a continuation application under 37 CFR 1.2 of prior application Ser. No. 867,812, filed Apr. 13, 1992, now abandoned.

FIELD OF THE INVENTION

This invention relates generally to so-called "ink tags" or "ink tacks", as defined below, providing a deterrent to article theft.

BACKGROUND OF THE INVENTION

A wide variety of patented approaches to ink tags is presently known, most having in common the containment of a theft-deterrent substance in one or more frangible containers, e.g. tubes or vials comprised of glass or rigid plastic disposed in a housing of the tag. The housing is secured to the article to be protected by attachment structure of a type which is releasable upon use of specialized release devices by authorized personnel.

Predecessor devices to ink tags which employed frangible tubes involved, as the article protected, bank vaults or safes. These devices taught two modes of vial fracturing, which have carried over into the ink tag designs.

In a first mode, evidenced in Loehle U.S. Pat. No. 4,299,176, a pin passes through the vial container, free of contact with the vials, to a rear side of the vial container, where the pin is secured by a locking device. The pin has vial-fracturing discs associated therewith in opposed facing relation to the vials. Efforts to attack the protected article which result in movement of the pin cause compressive fracture of the vials between the discs and the expelling of theft-deterrent substance therefrom.

In a second mode, evidenced also in the Loehle patent, attacks upon the integrity of the vial-containing compartment impart fracturing forces to the vials, without reliance on pin movement as the cause of vial fracture.

Known ink tags involving the first fracture mode include, e.g., Hogan U.S. Pat. No. 4,944,075 and Hogan et al. U.S. Pat. No. 5,054,172.

In the '075 patent, balls are provided between a pinhead and ink-containing vials and guide channels are formed in the device for movement of the balls, the channels being configured for enabling the pinhead to force the balls into rupturing engagement with the vials upon excess separating force being applied as between the pinhead and its locking member.

In the '172 patent, a pinhead includes a breaker element having a contoured surface for applying rupturing force to the vials upon excess separating force being applied as between the pinhead and its locking member. In use of either described ink tag, the housing containing the vials is secured to one side of an article to be protected by passing the pin therethrough and a locking member secures the pin therein on the opposite side of the article.

One known ink tag involving the second fracture mode in a first setting, wherein the attack on the vial housing is the imposition of force thereon, is set forth in Charlot et al. U.S. Pat. No. 5,031,287. In the '287 patent, the vial-containing housing has structure giving rise to ready flexure in a plurality of predetermined housing-flexure directions as opposed to other flexure directions and individual vials ar disposed in alignment respectively with the easier flexure directions, whereby it is said that a vial fractures upon the housing being subjected to flexing in any one of the predetermined housing-flexure directions, as might occur in an attempt to remove the housing from its locking member.

Other prior art ink tag patents involving the second fracture mode in such first setting include Wisecup U.S. Pat. No. 4,670,950, Heaton et al. U.S. Pat. No. 4,649,397 and Gustaffson et al. U.S. Pat. No. 4,483,049. Substance-dispensing openings, e.g., apertures extending into the housings and in communication with the vials, are common in these ink tags.

The second fracture mode is also known in a second setting, wherein the attack on the vial housing is, as in the Loehle patent, an attack on the integrity of the housing. Apt references here include Marshall U.S. Pat. No. 4,698,620 and Freed U.S. Pat. No. 4,603,326. The devices of these patents contrast with the devices involving the second fracture mode in the first setting in that the housing is not provided with substance-dispensing openings until the point of deterioration of the housing integrity.

The more desirable ink tags, from a practical viewpoint, as respects both manufacturing efficiency and use-effectiveness, are the ink tags of the first fracture mode.

The assignee hereof has long provided the industry with electronic surveillance (EAS) tags, i.e., tags which incorporate means responsive to incident energy to transmit alarm-indicating signals to remote apparatus to thereby generate alarm indication on efforts to unauthorizedly separate the tags from articles to which the tags are applied. Such EAS tags have also been equipped with means for themselves outputting alarm indication on such unauthorized separation efforts. The assignee has also provided the industry with what it terms "ink tacks", i.e., devices attachable to articles for ink dispensing on such unauthorized separation efforts, and has afforded the industry further products which combine the EAS capacity and the ink dispensing capacity, by adapting the ink tack for joinder with the EAS tag, a common locking member affixing both such components to the article to be protected. Thus, the invention herein, specific to the ink dispensing structure, is termed an "ink tack". Various of the above discussed prior art devices incorporate both ink dispensing and EAS facilities, but the distinction as between tag and tack is not recognized in the prior art.

SUMMARY OF THE INVENTION

The present invention has as its primary object the provision of improved ink tacks of the first fracture mode.

In attaining such objective, the present invention provides a theft-deterrent tack for application to an article to be protected against theft, the tack comprising a first component including a first housing having an open end and ceiling and wall structure bounding an interior space extending to the open end, the ceiling and wall structure being continuous, a second housing secured to the first housing and closing the interior space except for at least one opening extending therethrough into the interior space, the second housing having a generally flat surface facing the interior space and vial-confining members extending upwardly thereof into the interior space, at least one frangible vial disposed in the interior space and positioned in preselected position by the vial-confining members, the vial being disposed on the generally flat surface of the second housing and vial-fracturing means disposed in the interior space and supported for movement therein in interference path with the vial, and a second component including securement means for securing the first component to the article.

The securement means preferably comprises a pin member disposed in the interior space in engagement with the vial-fracturing means for displacement thereof into fracturing relation to the vial, the pin member being of length such that a free end thereof extends through the opening outwardly of the first component and a locking member for releasably engaging the pin member free end.

The vial-fracturing means preferably defines an opening for passage of the pin member therethrough. The vial-fracturing means desirably comprises a rigid element defining a generally flat surface in interference path with the vial. The pin member preferably includes a head part, the rigid element defining a surface confronting the head part and passing a shank part of the pin member therethrough. The rigid element may be of disc shape . The second housing may define a plurality of additional openings therethrough for dispensing of the fractured vial contents.

In the particularly depicted preferred embodiment, a pair of vials is included and the pin shank passage opening is located between the vials.

As per the above outset discussion, the invention contemplates the use of the described tack structure to the us thereof with EAS tags, the combination being applied to a garment to be protected against theft.

The foregoing and other objects and features of the invention will be further understood from the following detailed description of a preferred embodiment thereof and from the drawings, wherein like reference numerals identify like components throughout.

DESCRIPTION OF PREFERRED EMBODIMENTS AND PRACTICES

Figure 1:
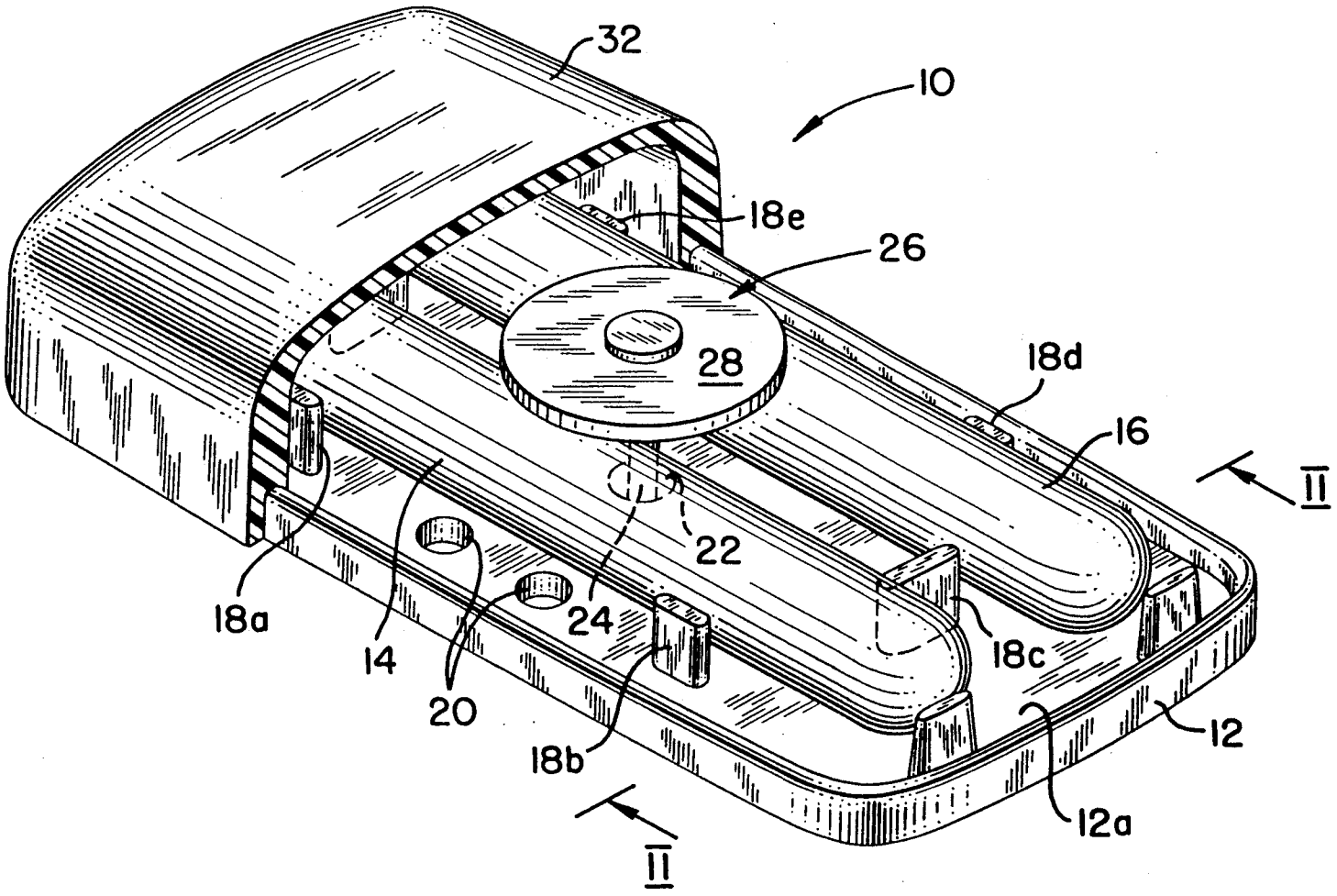
FIG. 1 is a perspective view of an ink tack housing assembly in accordance with the invention, partly broken away to show interior detail.
Figure 2:
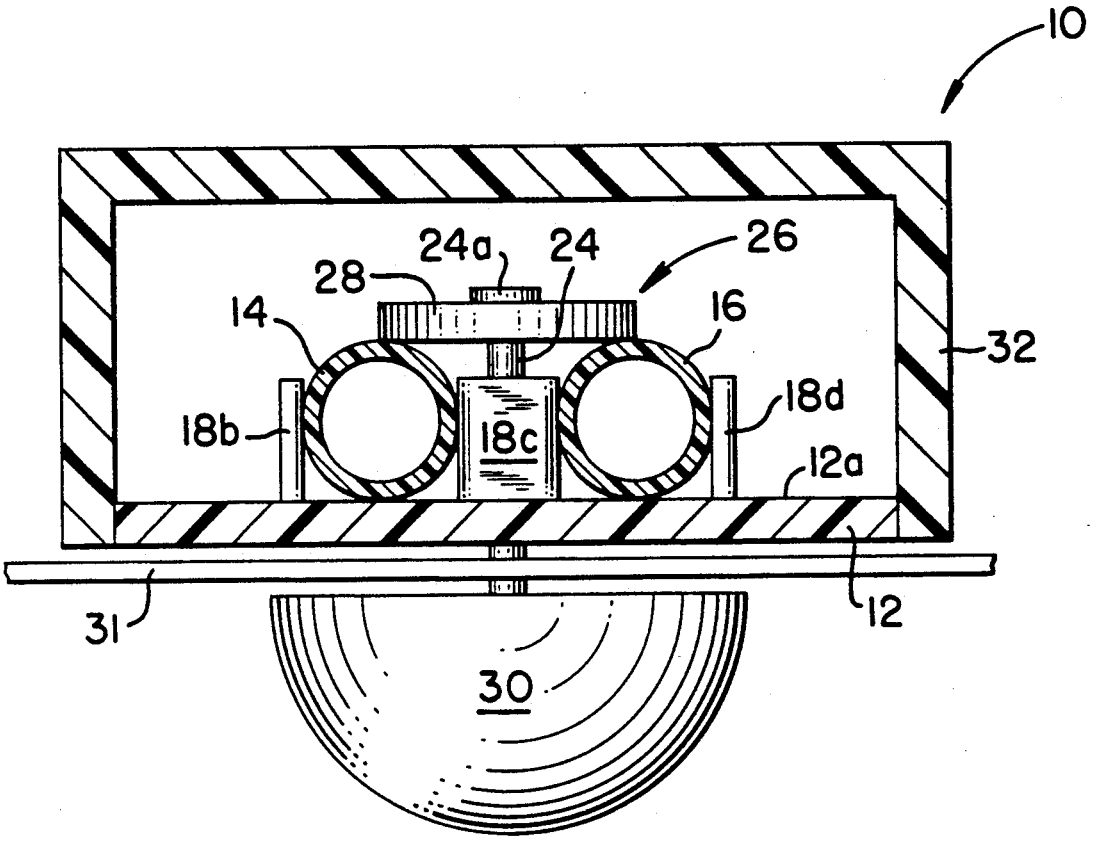
FIG. 2 is a sectional view of the FIG. 1 ink tack housing assembly as would be seen from plane II—II of FIG. 1, as applied lockingly to an article to be protected.

Referring to FIGS. 1 and 2, ink tack housing assembly 10 comprises a base 12 providing a flat supporting surface 12*a* for ink-containing vials 14 and 16. The vials are situated in laterally confined disposition through the action of positioning members formed integrally with base 12 and extending upwardly of surface 12*a*, such as are indicated by reference numerals 18*a*, 18*b*, 18*c*, 18*d* and 18*e*. Base 12 defines passages therethrough, such as are noted at 20, in registry with vials 14 and 16 for passage of ink from the housing assembly o fracture of the vials.

A further passage 22 exists through base 12 for pin 24 of the vial-fracturing means 26 which also includes a rigid force transfer element 28. Element 28 is preferably disc-shaped and has extent atop vials 14 and 16 as indicated particularly in FIG. 2. Pin 24 is of sufficient length to protrude outwardly of housing assembly 10 to be engageable with locking member 30 after passage through an article 31 to be protected.

Of consequence to the ink tack and its effectiveness is that vials 14 and 16 are substantially continuous with such fully flat vial-supporting surface 12*a* of base 12, giving rise to vial compressive fracture, without inducing bending stress in the vials.

Casing 32 is cooperative with base 12 for protectively enclosing the housing assembly components. Both casing 32 and base 12 may be comprised of rigid plastic material and suitably joined to one another, such as by an adhesive or direct mutual bonding of one to the other.

Figure 3:
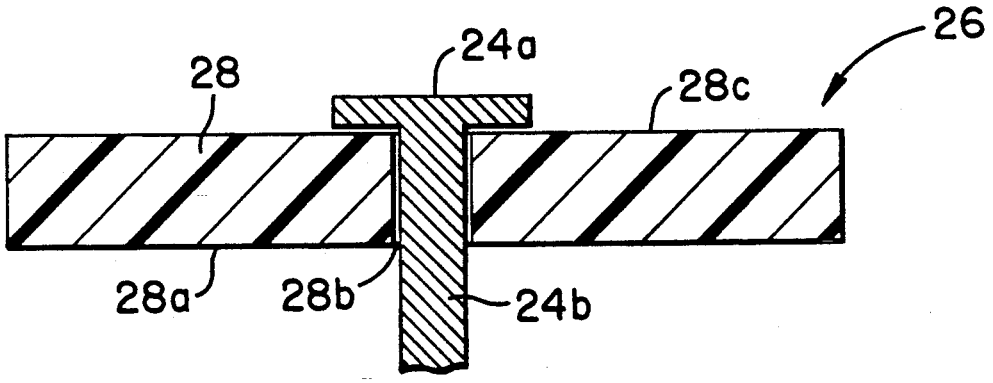
FIG. 3 is an enlarged partial sectional view of the vial-fracturing means of the FIG. 1 ink tack housing assembly.

Referring to FIG. 3, vial-fracturing means 26 is shown in enlarged sectional detail. Element 28 will be seen to define a flat undersurface 28*a* and to have a pin shank passage 28*b* therethrough and an upper surface 28*c*. Pin 24 has a pin head 24*a* dimensioned to be in confronting relation to surface 28*c*, i.e., a diameter exceeding that of passage 28*b*, and a pin shank 24*b* resident in passage 28*b*.

Efforts to unauthorizedly disassemble housing assembly 10 and locking member 30 involving the application of separating force beyond forces occurring in normal handling of article 31 will result in displacement of element 28 into fracturing relation with vials 14 and 16, substantially compressive fracture of the vials and dispensing of ink from the fractured vials through passages 20 and onto article 31.

Various changes in structure to the described tack housing and assembly may evidently be introduced without departing from the invention. By way of example, other substances than ink may be contained in vials 14 and 16, e.g., tar, dye, copying machine toner or a bleach may be used as article-staining substances. Alternatively, the vial content may be of foul-smelling character. Accordingly, it is to be understood that the particularly disclosed and depicted embodiment is intended in an illustrative and not in a limiting sense. The true spirit and scope of the invention is set forth in the following claims.

What is claimed is:

1. A theft-deterrent tack for application to an article to be protected against theft, said tack comprising:

A) a first housing having an open end and ceiling and wall structure bounding an interior space extending to the open end, the ceiling and wall structure being continuous, B) a second housing secured to the first housing and closing the interior space except for at least one opening extending therethrough into the interior space, said second housing having a flat undersurface facing said interior space and a plurality of vial-confining members extending upwardly from said surface into said interior space, C) at least one frangible vial disposed in said interior space located in preselected position by said vial-confining members, said vial having a cylindrical central portion and respective end portions contiguous with said central portion, said cylindrical central portion being in generally linewise contact along its length with said second housing flat undersurface of said second housing, said vial having an article staining substance contained therein, and D) vial-fracturing means comprising a flat surface and a pin member, said flat surface of said vial fracturing means disposed in said interior space between said vial and the ceiling of said first housing and supported for movement therein to come into direct compressive contact with said vial, said pin member having one end attached to said flat surface of said vial fracturing means and being of sufficient length to protrude through an opening in said second housing, said opposite end of said pin member being pointed to pass through an article to be protected, the disposition of said vial cylindrical central portion in linewise contact along its length with said flat undersurface of said second housing and said flat surface of said vial fracturing means giving rise to vial compressive fracture, to release said article staining substance upon movement of said vial-fracturing means into fracturing relation with said vial.

2. The invention claimed in claim 1 wherein said theft deterrent tack include engaging the pin member free end.

3. The invention claimed in claim 2 wherein said flat surface is of disc shape.

4. The invention claimed in claim 3 wherein said second housing defines a plurality of openings therethrough in addition to said at least one opening.

5. The invention claimed in claim 4 wherein a pair of said vials is included and wherein said at least one opening is located between said vials.

6. In combination:

a) an article intended to be protected from theft; and b) a theft-deterrent tack comprising:

1) a first component including

A) a first housing having an open end and ceiling and wall structure bounding an interior space extending to the open end, the ceiling and wall structure being continuous, B) a second housing secured to the first housing and closing the interior space except for at least one opening extending therethrough into the interior space, said second housing having a flat undersurface facing said interior space and a plurality of vial-confining members extending upwardly from said surface into said interior space, C) at least one frangible vial disposed in said interior space located in preselected position by said vial-confining members, said vial having a cylindrical central portion and respective end portions contiguous with said central portion, said cylindrical central portion being in generally linewise contact along its length with said second housing flat undersurface, said vial having an article staining substance contained therewithin, and D) vial-fracturing means comprising a flat surface and a pin member, said flat surface of said vial fracturing means disposed in said interior space between said vial and the ceiling of said first housing and supported for movement therein to come into direct compressive contact with said vial, said pin member having one end attached to said flat surface of said vial fracturing means and being of sufficient length to protrude through an opening in said second housing, said opposite end of said pin member being pointed to pass through the article to be protected, and 2) a second component including releasable securement means for securing the first component to said article, the disposition of said vial cylindrical central portion in linewise contact along its length with said flat undersurface of said second housing and said flat surface of said vial fracturing means giving rise to vial compressive fracture to release said article staining substance upon unauthorized attempt to separate said first and second components.

7. The invention claimed in claim 6 wherein said second component is a locking member for releasably engaging the pin member free end.

8. The invention claimed in claim 7 wherein said flat surface is of disc shape.

9. The invention claimed in claim 8 wherein said second housing defines a plurality of openings therethrough in addition to said at least one opening.

10. The invention claimed in claim 9 wherein a pair of said vials is included and wherein said at least one opening is located between said vials.

* * * * *

UNITED STATES PATENT AND TRADEMARK OFFICE

CERTIFICATE OF CORRECTION

PATENT NO. : 5,309,740
DATED : May 10, 1994
INVENTOR(S) : Norman B. Hansen

It is certified that error appears in the above-indentified patent and that said Letters Patent is hereby corrected as shown below:

Column 1 Line 17 change "e.g." to --e.g.,--
Column 1 Line 68 change "ar" to --are--
Column 3 Line 31 change "us" to --use--
Column 3 Line 62 change "o" to --on--
Column 5 Line 19 change "include" to --includes-- and after "includes" insert --a locking member for releasably--

Signed and Sealed this

First Day of November, 1994

*Attest:*

*Attesting Officer*

Bruce Lehman

BRUCE LEHMAN

*Commissioner of Patents and Trademarks*